US008287010B2

(12) United States Patent
Holzer

(10) Patent No.: US 8,287,010 B2
(45) Date of Patent: Oct. 16, 2012

(54) DOOR LOCKING SYSTEM HAVING A PLANAR STRIKER PLATE

(75) Inventor: Michael Holzer, Albstadt (DE)

(73) Assignee: Assa Abloy Sicherheitstechnik GmbH (DE)

( * ) Notice: Subject to any disclaimer, the term of this patent is extended or adjusted under 35 U.S.C. 154(b) by 946 days.

(21) Appl. No.: 12/013,869

(22) Filed: Jan. 14, 2008

(65) Prior Publication Data

US 2009/0072555 A1 Mar. 19, 2009

(30) Foreign Application Priority Data

Mar. 26, 2007 (DE) ..... 10 2007 014 324

(51) Int. Cl.
*E05B 15/02* (2006.01)
*E05B 15/00* (2006.01)

(52) U.S. Cl. ..... 292/341.16; 292/341.15; 292/DIG. 51

(58) Field of Classification Search ..... 292/51.5, 292/340, 341.15, 341.16, 341.17, 346, DIG. 51, 292/DIG. 65; 49/280
See application file for complete search history.

(56) References Cited

U.S. PATENT DOCUMENTS

| | | | | |
|---|---|---|---|---|
| 4,181,338 | A * | 1/1980 | Sterling | 292/341.17 |
| 4,626,010 | A * | 12/1986 | Hanchett et al. | 292/341.16 |
| 4,867,496 | A * | 9/1989 | Thomas | 292/341.16 |
| 5,613,718 | A * | 3/1997 | Lin | 292/346 |
| 5,934,720 | A * | 8/1999 | Karalius | 292/341.16 |
| 6,390,514 | B1 * | 5/2002 | Frolov | 292/92 |
| 7,144,053 | B2 * | 12/2006 | Bashford | 292/341.16 |
| 8,146,966 | B1 * | 4/2012 | Webb et al. | 292/341.15 |
| 8,157,302 | B1 * | 4/2012 | Webb et al. | 292/341.15 |
| 2004/0061343 | A1 * | 4/2004 | Bashford | 292/341.16 |
| 2007/0085354 | A1 * | 4/2007 | Hirschoff | 292/341.16 |

FOREIGN PATENT DOCUMENTS

| | | | |
|---|---|---|---|
| DE | 19631451 | A1 * | 2/1998 |
| DE | 10215014 | A1 * | 10/2003 |
| DE | 10310403 | A1 * | 9/2004 |
| DE | 102004012112 | B3 * | 8/2005 |

OTHER PUBLICATIONS

"Electric Strikes—A New Look", h.e.s, Inc., May 1986.
Hanchett Entry Systems, Inc. Price List for 9000 Series Electric Strike (Jan. 1986).
"Hanchett has Concealed Electric Strike," Locksmith Ledger Magazine, pp. 113-114 (Feb. 1986).
National Locksmith Magazine cover (Apr. 1986).
"The H.E.S. Concealed Electric Strike," Locksmith Ledger Mag, p. 52 (Dec. 1986).
Hanchett Entry Systems, Inc. Installation Instructions for 9000 Series Strike (Feb. 1986).

* cited by examiner

*Primary Examiner* — Carlos Lugo
*Assistant Examiner* — Alyson M Merlino
(74) *Attorney, Agent, or Firm* — Baker & Hostetler LLP

(57) ABSTRACT

A door locking system has a lock latch which is movable between a locked position projecting beyond a door lock cuff and a unlocked position retracted in the direction of the door lock cuff, and has a lock latch blocking device, movable between a blocking position and a release position, which fixes the lock latch in the locked position in the blocking position retracted toward the door lock, and releases the lock latch in the release position, which is extended in relation to the blocking position, in such a way that the lock latch is displaceable between the locked position and the unlocked position. The door locking system has a driver control mechanism.

10 Claims, 7 Drawing Sheets

DOOR LOCKING SYSTEM HAVING A PLANAR STRIKER PLATE

PRIORITY

The present invention claims priority of German Patent Application No. 102007014324.0 filed Mar. 26, 2007, the contents of which are incorporated herein in its entirety.

BACKGROUND OF THE INVENTION

The present invention relates to a door locking system, a striker plate for use in a door locking system, and a method for controlling a door locking system according to the independent claims.

A door locking system according to the species comprises a door lock situated in a door, an essentially planar striker plate, and a door opener.

The door lock has a lock latch, which is movable between a "locked" position projecting beyond the door lock cuff and a "unlocked" position retracted in the direction of the door lock cuff. Furthermore, a lock latch blocking device is provided on the door lock, which is movable between a "blocking" position and a "release" position. The lock latch blocking device is implemented for blocking the lock latch located in the "locked" position, i.e., in the position in which the lock latch is extended out of the door lock. For this purpose, the lock latch blocking device is functionally connected via a suitable mechanism to the lock latch, for example. Upon blocking of the lock latch in the "locked" position by the lock latch blocking device, which is actuated and/or located in the blocking position, a movement of the lock latch into the "unlocked" position is not possible. If the lock latch blocking device, in contrast, is moved from its "blocking" position into its "release" position, after the unblocking of the lock latch, it may be moved from the "locked" position into its "unlocked" position.

The lock latch blocking device is, for example, a tracer pin (latch blocking pin; deadbolt), which may be displaced between a position extended out of the lock latch, in which it is in its "release" position, toward the door lock into its "blocking position". In this pressed and/or actuated position of the lock latch blocking device and in particular of the tracer pin, the lock latch is blocked—manipulative opening of the door from the outside by pressing back the lock latch is not possible. In the "non-actuated" position of the lock latch blocking device, in contrast, the lock latch is released and may move spring-loaded between the "locked" position and the "unlocked" position, for example. However, other types of lock latch blocking devices, such as auxiliary latches, etc., come into consideration.

Door locks of this type having such a lock latch blocking device and a lock latch correspondingly functionally connected thereto are established, for example, in the ANSI lock systems (ANSI=American National Standard Institute), which are predominantly used in the USA, Canada, and also many Asian countries. In the lock variants widespread in mortise construction and/or cylinder lock construction, the lock latch blocking device is positioned above and/or below the lock latch (in particular in the mortise lock) or is seated on the rear side of the lock latch on the planar face (in particular in the cylinder lock, for example, as shown in FIG. 1).

The door lock inset in a door leaf also has a driver control mechanism, which is implemented in such a way that by moving the lock latch from the "locked" position into the "unlocked" position, the lock latch blocking device is retracted from its extended "release position", which releases the lock latch, in the direction of the door lock and/or in the direction of its "blocking position" and/or is "carried along" by the lock latch. Lock latch and lock latch blocking device thus move jointly in the direction of the door lock in this case from their particular extended positions. This may be achieved on one hand by pushing and/or pressing in the lock latch and on the other hand by a retraction of the lock latch toward the door lock which is controlled via a door knob, for example.

The door locking system according to the species also has an essentially planar striker plate having at least one lock latch recess, which the lock latch penetrates in the locked state of the door locking system in its "locked" position. For this purpose, the striker plate is inset in the door frame of a one-leaf door or in the cuff of the door leaf adjacent to the door leaf carrying the door lock in a two-leaf door. Door lock and striker plate are situated in relation to one another in such a way that the extended lock latch of the door lock in the extended state ("locked" position) engages in the lock latch recess of the striker plate when the door is closed and the lock latch blocking device is typically held by the striker plate or the blocking piece front edge of a door opener in its "blocking position" in the closed state of the door.

Furthermore, a door locking system according to the species comprises a door opener having a lock latch receptacle space, into which the lock latch projects in the locked state of the locking system. The door opener is typically situated on the striker plate for this purpose and inset in the door frame or, in two-leaf doors, in the door leaf. If the extended lock latch penetrates the lock latch recess of the striker plate when the door is closed and projects into the lock latch receptacle space of the door opener lying behind it, blocking of the door by the blocking piece situated in the door opener is achieved, against which the lock latch, which is located in the "locked" position, strikes in the opening direction of the door. For opening of the door mediated by the door opener, the blocking piece is released via an electromagnetically actuatable trigger mechanism, for example. If the door is now pressed in the door opening direction, the blocking piece is moved by the lock latch located in the "locked" position from the "lock latch blocking position" into a "lock latch release position" and the door may be pivoted open. Door openers of this type function especially reliably if the blocking piece is implemented as a pivot latch, so that the blocking piece pivots into the door opener interior from its "lock latch blocking position" into its "lock latch release position".

The combination of a door opener with a door lock having lock latch blocking device and lock latch into a door locking system has made it necessary up to this point, however, to provide milled grooves on the door frame panel (frame visible side), so that the extended lock latch, located in the "locked" position, may be pushed out from the lock latch receptacle space in the door opening direction. In addition, to cover the widely distributed variants of both door lock embodiment types (mortise and cylinder lock), up to this point striker plates having adapters (so-called "lip brackets") have been offered on the market, which typically form an integral unit ready for installation together with a pivot latch unit. A milled groove is also required in the door frame for installing these adapters in particular.

This prior art is illustrated in FIG. 2. The adapter, which adjoins the striker plate in the door opening direction, is used as a striker plate carrier, as a spacer to the door opener, and as a cover of a milled groove in the door frame panel, which is required for the installation. According to the preceding statements, this requirement is essentially based in the fact that the lock latch may only be moved from its "locked" position into its "unlocked" position as long as the lock latch is not blocked by the actuated lock latch blocking device. It has therefore been necessary up to this point, upon release of the lock latch by the door opener, either for the lock latch blocking device to be extended (=non-actuated) or for the extended and blocked lock latch in the "locked" position to be released solely by the blocking piece, which is pivoted into the lock latch release position, and the door thus being able to be pushed open, without the lock latch having to be shifted into its "locked" position for this purpose. To achieve precisely this opening possibility, the striker plate is typically interrupted in the opening direction of the door and has a generous recess together with the door frame here, through which the lock latch may be pushed out of the lock latch receptacle space upon opening of the door in the door opening direction in its "locked" position.

However, the embodiment typical up to this point of such a door locking system is already problematic in multiple regards. On one hand, the relatively large milled groove, which is required for the installation in the frame panel and for the opening capability of the door via the door opener, is disadvantageous in particular in regard to fire, heat, and noise protection. In addition, such a door locking system places increased requirements in regard to the installation and mounting effort, because significant reworking is necessary on standard door frames or leaves to obtain the milled groove. This has the result that a visually inconsistent impression of a door equipped with such a door locking system arises, so that this embodiment is also disadvantageous from aesthetic aspects. Finally, the milled groove also represents a security risk, because the large recess in the door frame represents a gateway for a manipulative access to the door opener.

SUMMARY OF THE INVENTION

The object of the present invention is thus to provide a door locking system according to the species of the type cited at the beginning, which simultaneously has improved fire, heat, and noise insulation properties, allows improved break-in protection, is easy to mount, and is also improved in regard to aesthetics.

The object is achieved by a door locking system, by a striker plate for use in a door locking system, and by a method for controlling a door locking system according to one of the independent claims. Advantageous refinements are specified in the dependent claims.

An essential feature of the invention is that the blocking piece is situated in relation to the lock latch blocking device of the door lock in such a way that, in the closed state of the door, the lock latch blocking device is seated on an outer edge of the blocking piece, which points toward the striker plate outer face in the "lock latch blocking position" of the blocking piece. When the door is closed, the lock latch blocking device is thus actuated or held in its "blocking position" by the blocking piece, which is in the "lock latch blocking position". In the closed state of the door, the blocking piece thus fulfills two functions simultaneously. On one hand, it prevents the door from being able to be pushed open, because the lock latch located in the "locked" position strikes against the blocking piece located in the "lock latch blocking position" in the opening direction of the door. In addition, it is ensured by the positioning of the blocking piece in the "lock latch blocking position" that the lock latch blocking device on the door lock side is held in its "blocking position", moved toward the door lock, by the blocking piece. In the locked state of the door, manipulative moving of the lock latch from the "locked" position into the "unlocked" position is thus made significantly more difficult, because the lock latch is blocked by the lock latch blocking device, located in the "blocking position". It thus cannot be moved from its "locked" position, extended in relation to the door lock, into the retracted "unlocked" position.

A further essential feature of the invention is the implementation of the striker plate having a sliding bevel running into the lock latch receptacle space, which is implemented in such a way that the lock latch is guided on the sliding bevel upon opening of the door and may be pushed back in the door opening direction by the sliding bevel in the direction of the door lock, i.e., from its "locked" position into its "unlocked" position. The sliding bevel is thus implemented in one piece with the striker plate and is preferably obtained by bending over punched-out lips, etc., in the striker plate. This is advantageous for reasons of cost, for example.

Concretely, during an opening procedure, the blocking piece, such as a pivot latch, pivots into the door opener. This may be caused, for example, by an electromagnetically triggered unblocking of the blocking piece and subsequent pushing open of the door, the blocking piece then being pressed by the lock latch, which strikes against the blocking piece, into its lock latch release position. The lock latch blocking device is no longer held in its actuated "blocking position" by the pivoting lock latch. The lock latch blocking device thus moves from its "blocking position" into its "release position" and enters the lock latch receptacle space. The blocking of the lock latch in the "blocked" position by the lock latch blocking device is thus removed, so that the lock latch slides on the sliding bevel upon a continuation of the opening procedure and is pushed out of the lock latch receptacle space thereby in the direction of its "unlocked" position. The lock latch carries along the extended lock latch blocking device from the lock latch receptacle space via the driver mechanism on the door lock side.

The sliding bevel runs from the striker plate outside surface into the lock latch receptacle space of the door opening in the closing direction of the door. The sliding bevel extends at most enough into the lock latch receptacle space that the blocking piece may pivot in its pivot movement into the door opener from the "lock latch blocking position" into the "lock latch release position" without obstruction and does not strike against the sliding bevel, for example. In the door opening direction, the sliding bevel terminates flush with the striker plate outside surface. In this way, it is ensured that the lock latch overcomes and/or slides over the striker plate without jamming upon opening of the door.

The sliding bevel is preferably implemented in such a way that the lock latch, having its tip area projecting into the lock latch receptacle space, slides nearly without transition from the blocking piece pivoted into the "lock latch release position" onto the sliding bevel. In this special embodiment, uniform guiding of the lock latch is possible, so that, for example, unintended jamming of the lock latch inside the lock latch receptacle space is prevented especially well. In addition, it is ensured that the lock latch does not strike the sliding bevel upon opening of the door, but rather slides in a uniform sliding movement from the blocking piece onto the sliding bevel. The operating comfort is thus increased in this embodiment, because the noise development of the door locking system during an opening procedure is comparatively low.

The sliding bevel may run linearly or also having a curved profile from the lock latch receptacle space to the striker plate outside surface. In addition, it is possible to implement the sliding bevel in multiple parts and/or to provide multiple sliding bevels, situated in pairs in particular, which project into the lock latch receptacle space. Each of the sliding bevels is always to be implemented in such a way that the lock latch projecting into the lock latch receptacle space and located in the "locked" position leads to the striker plate outside surface during an opening procedure of the door and/or pushes the lock latch out of the lock latch receptacle space in the direction of the door lock upon sliding over.

If multiple and in particular two sliding bevels are used, it is advantageous to situate then in such a way on the striker plate that two opposite edge areas of the lock latch slide over the sliding bevels. This configuration ensures that the sliding bevels impinge the lock latch uniformly with a thrust force. Jamming of the lock latch in the sliding phase may thus be prevented especially well.

In contrast to the prior art, the lock latch thus slides over the striker plate in the opening procedure. Only the special implementation of the sliding bevels on the striker plate side according to the present invention thus allows the lock latch to overcome the striker plate upon opening of the door. In this way, it is possible to dispense with the unattractive milled groove in the door frame area, because the striker plate recess may not be implemented as circumferential and an opening in the door frame in the door opening direction is also no longer necessary.

A further central basic idea of the present invention is the integration of an unblocking recess in the striker plate. The unblocking recess adjoins the lock latch recess without a transition and/or directly. The positioning of the unblocking recess is essentially oriented according to the positioning of the lock latch blocking device in relation to the lock latch. If the lock latch blocking device is above or below the lock latch in relation to the pivot axis of the blocking piece of the door opener, the unblocking recess is accordingly situated above or below the lock latch recess. If the lock latch blocking device, as in the door lock from FIG. 1, is in front of the lock latch in the opening direction of the door, the unblocking recess is positioned in front of the lock latch recess on the striker plate in the door opening direction.

The unblocking recess is fundamentally implemented in such a way that the lock latch blocking device may be moved by the driver mechanism upon opening of the door from its "release position" in the direction of its "blocking position" toward the door lock with the lock latch sliding over the sliding bevel and moving from the "locked" position into the "unlocked" position until it overcomes the striker plate in the opening direction of the door without a stop. This feature takes into consideration the circumstance that the lock latch blocking device must also overcome the striker plate in the opening direction of the door to allow opening of the door. In addition, this overcoming must occur in such a way that the lock latch blocking device does not block the lock latch in the opening procedure, because otherwise it would not be possible to retract of the lock latch from the "locked" position into the "unlocked" position and thus the lock latch also could not overcome the striker plate. However, it must be ensured simultaneously that the lock latch is blocked in the closed and locked state of the door by a lock latch blocking device which is actuated and/or moved toward the door lock so as not to reduce the security standard of such a door locking system.

The unblocking recess is dimensioned as small as possible in its dimensions in the plane of the striker plate outside surface, to make the clearance between the lock latch blocking device upon passage of the unblocking recess ideally nearly free of play. In this way, for example, manipulative access to the door opener of the door locking system according to the invention is additionally made more difficult. The width of the unblocking recess, i.e., the distance between the two recess inside edges of the striker plate delimiting the unblocking recess in the direction of the pivot axis, is thus oriented essentially to the width of the lock latch blocking device in this direction. The unblocking recess is thus typically implemented as significantly smaller in its width than the adjoining lock latch recess. The length of the unblocking recess is also ideally tailored to the lock latch blocking device. The length of the unblocking recess corresponds to the dimension of the unblocking recess in the door opening direction up to the striker plate inside edge, which delimits the unblocking recess in the door opening direction. The adaptation of the length of the unblocking recess is essentially oriented to the movement course of the lock latch blocking device from the "release position" in the direction of the "blocking" position. The cardinal vertex for the smallest possible design of the length of the unblocking recess is in particular the point at which the lock latch blocking device is retracted enough in the direction of the door lock that it may just overcome the striker plate outside surface without obstruction. The unblocking recess must extend at least up to here in regard to its length.

Finally, a further core element of the invention comprises implementing the lock latch recess on the striker plate side having a closed contour, which completely encloses the lock latch recess including the unblocking recess adjoining it, in contrast to the striker plates used up to this point in the prior art. This closed contour, which encloses the lock latch recess and the unblocking recess, significantly increases the mechanical stability of the striker plate, by which the door locking system is better protected overall against the effect of force. In addition, the door locking system according to the present invention is distinguished by improved fire, noise, and heat insulating properties, because a milled groove of the door frame is no longer necessary.

The contradiction that the lock latch blocking device must be actuated on one hand to block the extended lock latch and must release the lock latch simultaneously to open the door, because of which its extendibility into the lock latch receptacle space is required (so that the lock latch may be shifted by sliding over the sliding face in the opening procedure of the door to overcome the striker plate in the door lock direction), is thus achieved according to the invention by the following features: usage of the outer edge of the blocking piece to actuate the lock latch blocking device, a sliding bevel which is situated on the striker plate side and runs into the lock latch receptacle space; an unblocking recess adjoining the lock latch recess in the opening direction of the door; and lock latch recess and unblocking recess on the striker plate side having shared closed contour.

The unblocking recess of the striker plate is thus decisive for the solution according to the invention on one hand. For this purpose, according to the invention, the striker plate, which is essentially implemented as planar, also has an unblocking recess in addition to the lock latch recess, the lock latch recess and the blocking recess passing directly into one another and thus being enclosed by a shared contour. In contrast to the prior art, the lock latch recess is thus not implemented as open in the opening direction of the door, but rather is completely enclosed by the striker plate together with the unblocking recess.

The unblocking recess first allows the lock latch blocking device, which is positioned in front of the lock latch in the door opening direction, not to strike the lock latch recess in the forward edge section (in relation to the door opening direction) and thus prevent opening of the door. The unblocking recess allows the lock latch blocking device rather to be retracted via the driver mechanism on the door lock side by the lock latch, which slides over the sliding bevel and thus moves toward the door lock into the "unlocked" position, toward the door lock without a stop. Jamming of the door by a lock latch blocking device striking against the inner edge of the lock latch recess is thus prevented.

In a preferred embodiment, the front edge of the blocking piece pointing toward the striker plate outside surface has a receptacle recess, which is implemented in such a way that the lock latch blocking device, which is seated on the outside edge and is thus held in the "blocking position", projects into the receptacle recess on the blocking piece side and/or strikes against the blocking piece within this receptacle recess. This embodiment is advantageous in that the positioning of the lock latch blocking device seated on the outside edge of the blocking piece is additionally secured by the receptacle recess. A further advantage which results from this configuration is that manipulation of such a door locking system according to the present invention is additionally made more difficult. It is also possible to provide multiple receptacle recesses, which are particularly situated symmetrically to one another, in the outside edge of the blocking piece. In this way, for example, the door locking system is usable both for right-handed and also for left-handed doors without special alterations.

It is especially preferable to implement the lock latch recess and the unblocking recess having a shared axis of symmetry running in the door opening direction. This embodiment also takes the desired embodiment of a door locking system according to the invention, of allowing a use of such a door locking system for right-handed and for left-handed doors, into consideration without alteration measures being required for this purpose.

Furthermore, it is preferable for the striker plate to have a further sliding bevel and/or entry bevel for the lock latch in its front edge in relation to the door opening direction, which is implemented in such a way that it controls a displacement of the lock latch when sliding over the further sliding bevel in the direction of the door lock upon closing of the door. In addition to the sliding bevel running into the lock latch receptacle space, which is implemented in such a way that the lock latch is guided on the sliding bevel upon opening of the door, in this embodiment, a further sliding bevel is thus provided, which the lock latch slides along from the front edge of the striker plate in the door opening direction upon closing of the door. This further sliding bevel ("entry bevel") thus does not run into the lock latch receptacle space. The essentially planar striker plate thus rather has an area beveled in relation to the striker plate plane, by which the lock latch is shifted toward the door lock and/or in the direction of its "unlocked" position as it slides over it upon closing of the door. Comparably to the sliding bevel projecting into the lock latch receptacle space, the further sliding bevel is thus also used for guiding the lock latch on the striker plate. The further sliding bevel is also preferably implemented in one piece with the striker plate for this purpose and may be obtained by angling, bending, or chamfering the front striker plate edge. Upon closing of the door, this further sliding bevel allows easy sliding of the lock latch and/or the lock latch blocking device on the striker plate surface. In addition to a planar implementation, a convex implementation of the further sliding bevel in the door opening direction has been proven to be especially favorable in particular. In this embodiment, the sliding bevel which runs into the lock latch receptacle space and also the further sliding bevel, which runs from the striker plate front edge to the striker plate surface, run outside the essentially planar striker plate outside surface.

The unblocking recess preferably extends up into the further sliding bevel. In this way, the use of an especially narrow striker plate is possible, so that the available space may be exploited in the best possible way up to the front edge of the striker plate pointing in the opening direction. In this way, a depression in the area of the unblocking recess, which is offset in relation to the essentially planar level of the striker plate outside surface, may additionally be obtained especially simply. Depressed is to be understood as an offset of this area in the direction of the striker plate inside surface. Such a depression is advantageous in that the required stroke distance for the lock latch blocking device to overcome the door may thus be reduced, because it does not have to overcome the striker plate outside surface lying further toward the door lock, but rather only the surface of the depression, which is set back in relation to the striker plate outside surface. In the sequence of the movement of the lock latch blocking device from the "release position" in the direction of the "blocking position" during an opening procedure, the lock latch blocking device may thus be guided over the striker plate earlier in the opening direction of the door. The striker plate may thus be made especially narrow in this embodiment.

A striker plate whose lock latch recess has a stop against which the blocking piece and in particular the pivot latch of the door opener strikes during a movement and in particular a pivot movement from its "lock latch release position" into the "lock latch blocking position" has been proven to be especially favorable. For this purpose, the outside edge of the blocking piece projects in front of the door opener in the lock latch blocking position and thus projects into the lock latch recess on the striker plate side. This has the advantage that the access to the lock latch in the locked state of the door locking system is made more difficult.

The blocking piece stop on the striker plate is preferably divided in two in such a way that two opposite edge areas of the blocking piece strike against the striker plate. This embodiment is especially preferable, for example, because one-sided material strains may be prevented both on the blocking piece and also on the striker plate.

The striker plate is preferably connected in a friction-locked or formfitting way to the door opener in particular. A screw connection has been proven to be especially suitable here, the striker plate preferably having a first oblong hole, which is situated in the door opening direction above the lock latch recess, and a second oblong hole, which is situated in the door opening direction below the lock latch recess, for this purpose. The first and second oblong holes are ideally situated on the striker plate in such a way that the relative position of the door opener in relation to the striker plate is variable in the door opening direction or vertically and/or orthogonally to the door opening direction. In this way, using comparatively simple means, a possibility is provided of adapting the positioning of the door opener in relation to the striker plate to the particular installation conditions. The door opener may specifically be shifted along the oblong holes in relation to the striker plate in this embodiment. If the oblong holes run in the door opening direction, the door opener may be adjusted in or opposite to the door opening direction. In contrast, if the oblong holes run vertically and/or orthogonally to the door opening direction, it is possible to adjust the door opener orthogonally to the door opening direction. The oblong holes are preferably implemented in such a way that an adjustment of the door opener in the scope of +/−2.5 mm is possible starting from a middle position. In the generally typical installation state of the striker plate, the latter possibility thus results in a height adjustability of the door opener along the door frame. Both types of the oblong hole configuration make adjusting the door locking system easier in the scope of mounting, for example.

In addition, it is preferable to provide clamping ribs, which allow a raster adjustment of the relative position between the striker plate and the door opener by interlocking, on the striker plate and on the door opener for a connection with especially secure positioning between striker plate and door opener. Unintended slipping of striker plate and door opener to one another may thus be prevented especially effectively.

A high variability in regard to the installation conditions may additionally be achieved by positioning a spacer between the striker plate and the door opener. This spacer is preferably implemented in one piece, such as a one-piece cast part, or in multiple pieces, for example, as a multilayer plate construction, in the latter case, the spacer in particular being formed by separable, essentially planar individual layers to be able to adjust a spacing between striker plate and pivot latch unit via plate number and/or plate thickness. To also prevent slipping of the spacer in relation to the door opener and/or to the striker plate here, of course, clamping ribs may also be provided here for the raster adjustment. It has been proven to be especially advantageous to provide the cast part and/or the spacer plates with through holes in such a way that the fastening screws which connect the striker plate to the door opener are each guided through one through opening (and/or with the spacer plates through corresponding through openings). In addition, it is possible to also implement these through holes in the form of oblong holes running in the door opening direction or alternatively running orthogonally to the door opening direction, to also obtain adjustability of the spacer in relation to the door opener and/or in relation to the striker plate. Alternatively, it is possible to provide the oblong holes solely in the striker plate and thus allow adjustability of the door opener spacer unit in relation to the striker plate. In this way, adjustment of the door opener in relation to the striker plate and simultaneously adjustment and fixing of the spacer between the door opener and the striker plate are possible. In a further advantageous embodiment, the spacer also comprises a sliding bevel, which runs into the striker plate receptacle space and runs in such a way that the lock latch is at least partially guided on this sliding bevel upon opening of the door. This sliding bevel may be implemented in such a way that it supplements the sliding bevel on the striker plate side and forms a functionally coherent sliding bevel therewith, or completely replaces the sliding bevel on the striker plate side running into the lock latch receptacle space. This is also true for the further sliding bevel ("entry bevel"), which may also be integrated partially or completely in the spacer.

For easier installation of a door locking system according to the invention, it has also proven to be advantageous to equip the door opener with a final control element for adjusting the rotational angle stop of the blocking piece and in particular the pivot latch in the door opener. This final control element may be a set screw acting on the pivot latch orthogonally to the pivot axis of the pivot latch. Using an adjustable rotational angle stop, the dimension of the pivot movement of the blocking piece in the door opener may thus be adapted to the environmental conditions on location at the installed door opener.

The object of the invention is also achieved by a striker plate for use in a door locking system having a door opener and a door lock in the embodiment described above. It is thus possible according to the invention to achieve the effects described above by equipping the striker plate with at least one sliding bevel projecting into the lock latch receptacle space of the door opener and an unblocking recess in particular in the way described above. This separate striker plate allows the use of known locks having lock latch blocking device in known door openers, which particularly have a pivot latch. It is thus possible to retrofit a door locking system known from the prior art with a striker plate according to the invention and thus to obtain the advantages described above in a door locking system having a known door opener and a known door lock.

The unblocking recess is preferably implemented integrally with the lock latch recess. This means that the unblocking recess and the lock latch recess are enclosed by a shared contour. The striker plate according to the present invention thus provides a uniform and thus aesthetic impression to the observer and simultaneously has improved heat, fire, and noise protection properties. Moreover, it is possible with the striker plate according to the invention to obtain a door locking system of the type cited above without additional milling work being required on the door frame, for example.

Finally, the object is also achieved by a method for controlling a door locking system according to the invention having a door opener, a door lock, and a striker plate which are implemented essentially in the way described above. The control sequence may be divided into two essential phases: the closing procedure and the opening procedure.

The sequence of a closing procedure is distinguished by the sequential execution of the following method steps: sliding over the striker plate outside surface by the lock latch controlled by the striker plate and carrying along the latch blocking device; sliding of the lock latch over the blocking piece located in the lock latch blocking position; extension of the lock latch into the lock latch receptacle space in the "locked" position and seating of the lock latch blocking device on the outside edge of the blocking piece and thus blocking of the lock latch in the "locked" position by the lock latch blocking device located in the blocking position. An essential difference to the prior art in the method according to the invention is thus that upon closing of the door, the striker plate outside surface is overcome by the lock latch. The contour of the unit made of lock latch recess and unblocking recess, which is circumferential in contrast to the prior art, is first made possible in this way.

The opening procedure according to the present invention is distinguished by sequential execution of the following method steps: pivoting of the blocking piece of the door opener from the lock latch blocking position into the lock latch release position; extension of the lock latch blocking device into the lock latch receptacle space; sliding of the lock latch over the sliding bevel in the opening direction of the door and thus moving the lock latch from the "locked" position into the "unlocked" position; carrying along and/or lifting of the lock latch blocking device out of the lock latch receptacle space, without obstruction in particular in regard to the striker plate, in the area of the unblocking recess; sliding of the lock latch over the striker plate in the opening direction of the door; and extension of the latch blocking device and the lock latch after sliding over the striker plate into the "locked" position or into the "release position". The essential feature of the method according to the invention for controlling an opening procedure is the carrying along of the lock latch blocking device by the lock latch in the area of the unblocking recess without obstruction and/or jamming. Only this step allows the lock latch sliding over the sliding bevel to carry along the lock latch blocking device out of the lock latch receptacle space and/or the unit made of lock latch receptacle and unblocking recess in the striker plate far enough that the lock latch blocking device is lifted over the outside surface of the striker plate. Only in this way is it possible to provide a contour completely enclosing these two recesses here, which finally results, for example, in improved fire, noise, and heat insulation properties and also very especially in increased manipulation protection.

BRIEF DESCRIPTION OF THE DRAWINGS

In the following, the invention is explained in greater detail on the basis of the exemplary embodiments illustrated in the figures. In the schematic figures.

DETAILED DESCRIPTION

Figure 1:
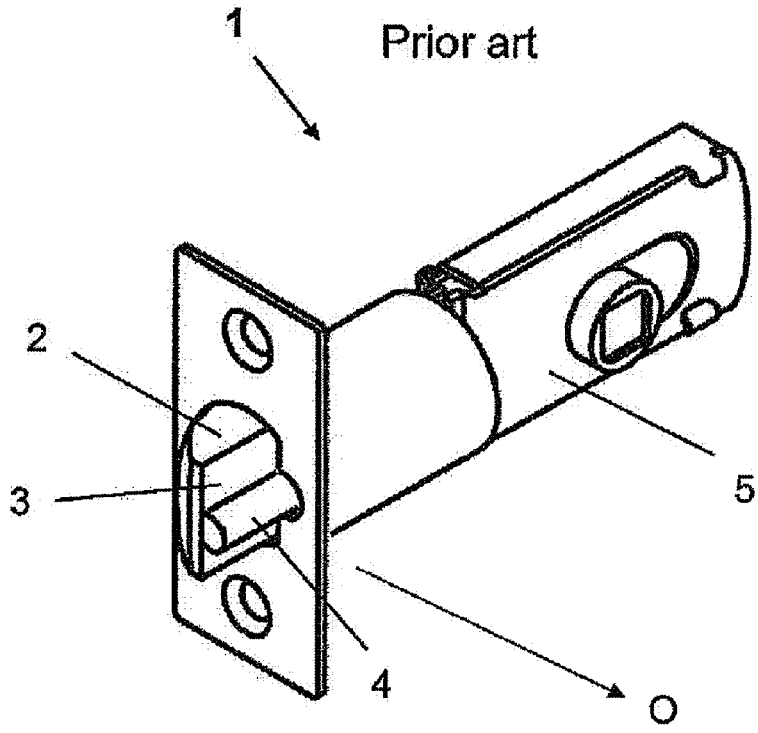
FIG. 1: shows a cylinder door lock in a perspective view according to the prior art.

In the embodiment described in the following, identical components are provided with identical reference numerals.

The door lock 1 from FIG. 1 is a cylinder lock known from the prior art. The door lock 1 is typically embedded in the cuff (not shown) of a door leaf (not shown) and has the lock latch 2 and the tracer pin 4, which presses against the planar back side 3 of the lock latch 2, projecting beyond the door cuff. Both the lock latch 2 and also the tracer pin 4 are spring-loaded and may thus be displaced from their extended position from FIG. 1 in the direction of the housing of the door lock 1 against a spring force.

To open a door (not shown) equipped with such a door lock 1, the door lock 1 comprises an actuating mechanism, identified as a whole by 5. The actuating mechanism is implemented in such a way that the projecting lock latch 2 and the projecting tracer pin 4 may be moved back against the spring force in the direction of the door lock 1 by applying a door handle or knob, for example.

The lock latch 2 may essentially be shifted between the "locked" position shown in FIG. 1, in which it projects in the installed state beyond the door cuff (not shown), and the "unlocked" position, in which it is moved back toward the door lock 1.

The tracer pin 4, which functions here as a lock latch blocking device, may be displaced between the "release position" shown in FIG. 1, in which it releases a movement of the lock latch 2 between the "locked" position and the "unlocked" position, and an actuated "blocking position", in which it fixes the lock latch in the extended "locked" position. To actuate the lock latch blocking device or the tracer pin 4, it is pressed from the "release position" ("extended position") shown in FIG. 1 toward the door lock 1 into its "blocking position". This pressing in may be caused, for example, by a striker plate in the closed state of a door equipped with the door lock 1. As long as the tracer pin 4 is pressed and/or actuated, the lock latch 2 is fixed as soon as it is located in the extended "locked" position.

A further essential feature of the actuating mechanism 5 is a driver mechanism, which is implemented in such a way that upon the lock latch 2 being pushed back (for example, using a striker plate) or being retracted (which may be triggered via the actuating mechanism) from the extended "locked" position into the "unlocked" position retracted or inserted into the door lock 1, it carries along the tracer pin 4 in such a way that it is moved together with the lock latch 2 in the direction of the door lock, i.e., from its "release position" in the direction of its "blocking position".

Figure 2:
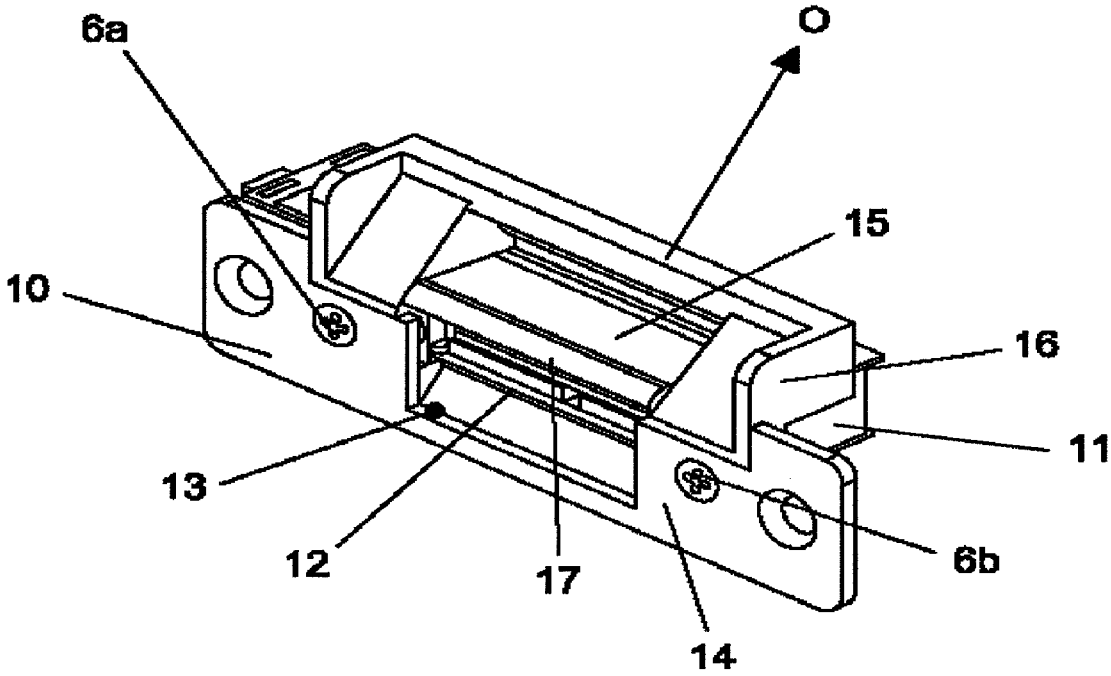
Prior art Fig. 2
FIG. 2: shows a door opener unit according to the prior art in a perspective view.

FIG. 2 illustrates a striker plate 10 known from the prior art having a door opener 11 also known from the prior art. The striker plate 10 adjoins the door opener 11 at its striker plate inside surface and is screwed thereon via the two fastening screws 6*a* and 6*b*.

The door opener 11 has a blocking device implemented as a pivot latch 15, which may be electromagnetically triggered remote-controlled via a remote trigger unit (not shown), such as a pushbutton. To release a door, the pivot latch 15 is pivotable between a "lock latch blocking position" shown in FIG. 2 and a "lock latch release position", pivoted into the door opener 11. The door opener 11 also has a lock latch receptacle space 12, which is implemented to engage a lock latch of a door lock (not shown) on the door leaf side, as shown in FIG. 1, for example. If the lock latch 2 located in the "locked" position engages behind (in relation to the door opening direction O) the pivot latch 15 located in the "lock latch blocking position", the door is blocked. Upon an opening procedure triggered via the door opener 11, the pivot latch is electromagnetically unblocked and, upon pressing of the door in the door opening direction O, is pivoted by the lock latch 2 striking against the pivot latch 15 into its "lock latch release position". The lock latch 2 is thus released and may be pushed out of the lock latch receptacle space 12 in the door opening direction O in its extended "locked" position and/or the door may be pressed open in the door opening direction O.

To allow the opening procedure described above, a striker plate recess 13, open in the door opening direction O, is provided in the prior art on the striker plate 10, which is situated above the lock latch receptacle space 12 in the direction of the striker plate outside surface 14. Furthermore, an adapter 16 ("lip bracket") adjoins the striker plate recess 13 in the door opening direction O, which comprises lateral sliding bevels, which may be used to guide a lock latch blocking device, for example. The adapter 16 thus particularly ensures the compatibility of the door opener 11, both with cylinder locks and also with mortise locks, only the working of the striker plate 10 and the door opener 11 together with the cylinder lock (=door lock 1) having been described here for the sake of clarity.

Furthermore, the adapter encloses, in a U-shaped profile, a milled groove in the door frame (not shown), which is necessary so that the extended lock latch 2 located in the "locked" position may be pushed laterally out of the lock latch receptacle space 12 of the door opener 11 in the door opening direction O, without the lock latch 2 striking against the striker plate 10 or the door frame (not shown). For this reason, significant milling work in the door frame (not shown) is necessary for installation of a closing system having the components from FIGS. 1 and 2.

In addition, it is obvious from FIG. 2 that the unit made of striker plate 10 and door opener is solely closed by the pivot latch 15 in the door opening direction O. The possibility thus exists with the unit made of striker plate 10 and door opener 11 shown in FIG. 2 of accessing the door opener 11 laterally when the door is closed via the opening solely delimited by the pivot latch 15. This is problematic in that a direct manipulative access to the blocking mechanism of the door opener 11 is possible here. In addition, the extensive milling in the door frame (not shown) also represents a passage possibility for noise, heat, and flames, so that a door equipped with such a door locking system has reduced insulation properties in regard to noise, heat, and fire.

Upon closing of the door, the beveled or convexly curved front side of the lock latch 2 comes into contact with the front edge, facing toward the striker plate outside surface 14, or the pivot latch tip 17 of the pivot latch 15, upon which the lock latch 2 is pushed back against its pre-tension force in the direction of the door lock 1 as it slides over the front side of the lock latch 2, until it has overcome the pivot latch tip 17 and falls into the lock latch receptacle space 12 in its "locked" position. When sliding over the pivot latch 15, the lock latch 2 carries along the tracer pin in the direction of the door lock 1 via the driver mechanism on the door lock side. If the lock latch 2 has overcome the blocking piece 15, it projects into the lock latch receptacle space 12, so that the lock latch 2 is then held by three borders or edges of the striker plate recess 13 and the pivot latch 15 in the lock latch receptacle space 12. The door is thus closed. In this state, the tracer pin 4 of the door lock 1 is seated in a pressed back position (=blocking position) on the pivot latch tip 17 (i.e., it does not fall jointly with the lock latch 2 into the lock latch receptacle space 12 on the door opener side), so that the lock latch 2 is blocked and may no longer be manipulatively moved (=latch blocking function). If the pivot latch 15 is pivoted during an opening procedure from the "lock latch blocking position" into the "lock latch release position", the tracer pin 4 extends into its "release position" again, by which the blocking of the lock latch 2 is canceled.

Figure 3A:
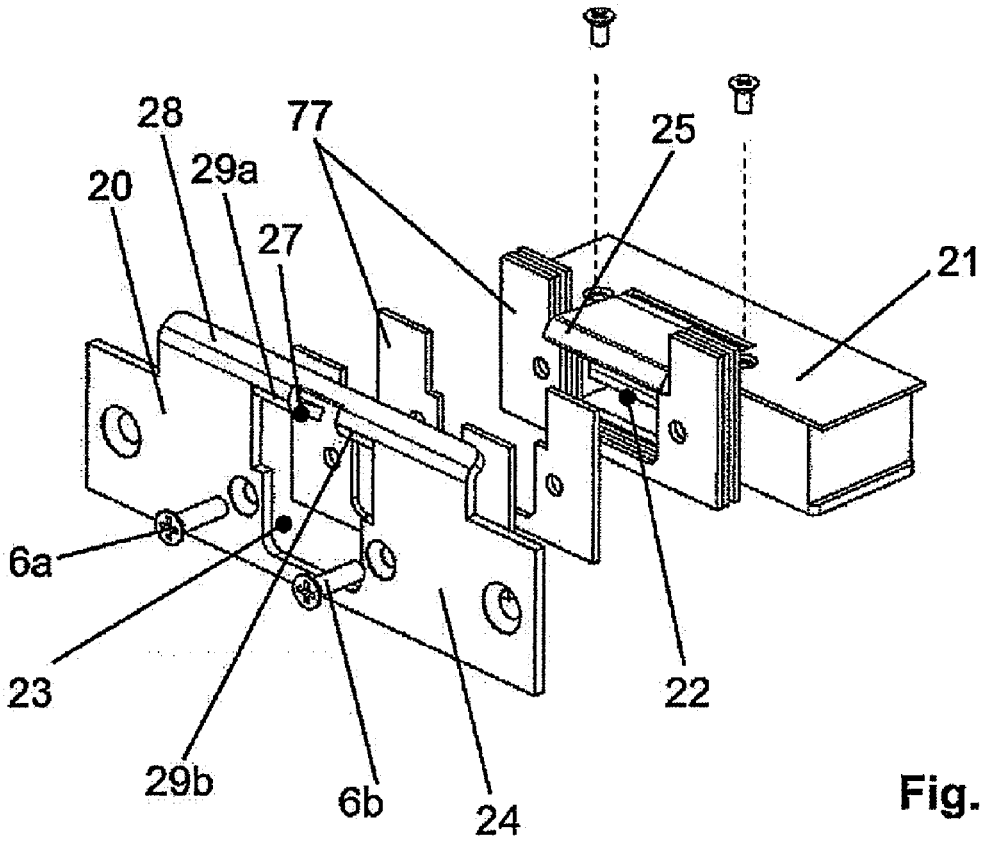
FIG. 3*a*: shows a first embodiment of a striker plate according to the invention having a door opener unit in an exploded view.
Figure 3B:
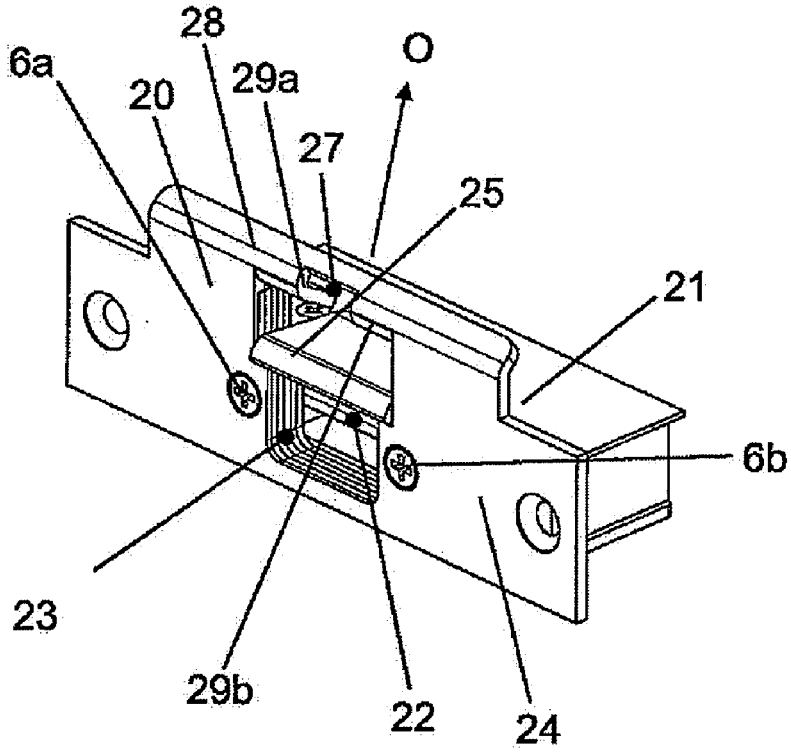
FIG. 3*b*: shows the embodiment from FIG. 3*a* having the door opener unit in a perspective view.

A striker plate 20 according to the invention is disclosed in FIGS. 3*a* and 3*b*, which, together with the door opener 21 and a door lock (not shown), as disclosed in FIG. 1, for example, forms a door locking system according to the invention. For this purpose, the striker plate 20 has a lock latch recess 23, an unblocking recess 27, sliding bevels 29*a* and 29*b*, and a further sliding bevel, which is identified in the following as the entry bevel 28. The door opener 21 comprises a lock latch receptacle space 22 and a blocking piece 25. The spacer plates 77, via which the spacing between the striker plate 20 and the door opener 21 may be set, are situated between the door opener 21 and the striker plate 20.

The sliding bevels 29*a* and 29*b* on the striker plate side are implemented in one piece with the striker plate 20 and run from the striker plate outside surface 24 opposite to the door opening direction O into the lock latch receptacle space 22. The entry bevel 28 angled in relation to the striker plate outside surface 24 runs in the direction of the sliding bevels 29*a* and 29*b*, however, in the door opening direction O and, in contrast to the sliding bevels 29*a* and 29*b*, not into the lock latch receptacle space 22, but rather towards the outside.

The entry bevel 28 is essentially used so that the lock latch 2 (not shown) may overcome the striker plate 20 upon closing of the door (not shown). For this purpose, the lock latch slides opposite to the door opening direction O along the entry bevel 28 and is thus pushed by the entry bevel 28 on the striker plate side from its "locked" position in the direction of the door lock and/or in the direction of its "unlocked" position until it is at the height of the striker plate outside surface 24, to overcome the striker plate, which is implemented as web-like in this area. In contrast to the prior art, in the striker plate 20 according to the invention, the striker plate outside surface 24 is thus overcome by the lock latch opposite to the door opening direction O during a closing procedure. This is necessary because here the lock latch recess 23 on the striker plate 20, which the lock latch penetrates in the locked state, is completely enclosed by the striker plate 20. The entry bevel 28 controls this overcoming procedure and makes it easier.

Upon a continuation of the closing procedure, the lock latch subsequently also slides over the front edge of the pivot latch 25 pointing toward the striker plate outside surface 24 and finally enters the lock latch receptacle space 22 in its "locked" position. For this purpose, the pivot latch also has a guide bevel running convexly in profile in the area of the front edge. The tracer pin, in contrast, is seated in its "blocking position" on the front edge of the pivot latch 25 and thus blocks the lock latch in its "locked" position. It is now not possible to pivot the door open in the opening direction O, because the blocked lock latch strikes against the fixed pivot latch 25 in the door opening direction O.

The sliding bevels 29*a* and 29*b* are now of central significance for opening the door. After the pivot latch 25 has been electromagnetically released to open the door, when the door is pushed open, the pivot latch 25 is pivoted by the lock latch located in the "locked" position from the "lock latch blocking position" shown in FIGS. 3*a* and 3*b* into the "lock latch release position" in the door opener 21. By this pivoting in, it is possible for the tracer pin (not shown) previously seated on the front edge of the pivot latch 25 to extend into its "release position" and/or to enter the lock latch receptacle space. The locking of the lock latch (not shown) by the lock latch blocking device (tracer pin) in the "locked" position is thus canceled. As soon as the lock latch, upon a continuation of the opening procedure in the door opening direction O, hits the two sliding bevels 29*a* and 29*b*, it is pushed by sliding over the sliding bevels 29*a* and 29*b* in the door opening direction O out of the lock latch receptacle space 22 toward the door lock in the direction of its "unlocked" position. This procedure is continued until the lock latch slides over the striker plate outside surface 24 in the door opening direction O and the door may thus be completely opened. The lock latch carries along the tracer pin out of the lock latch receptacle space 22 via the driver mechanism.

If the door lock is implemented in the way shown in FIG. 1, for example, the tracer pin 4 is mounted in front of the lock latch 2 in the door opening direction O. To prevent jamming of the door and/or striking of the tracer pin 4*a* against the striker plate 20, which completely encloses the lock latch recess 23, during an opening procedure, the striker plate has an unblocking recess 27, which, in the embodiment shown in FIGS. 3*a* and 3*b*, directly adjoins the lock latch recess 23 in the door opening direction O, so that the lock latch recess 23 and the unblocking recess 27 are completely enclosed by the striker plate 20 using a shared contour. The lock latch recess 23 and the unblocking recess 27 thus form a joint coherent opening in the striker plate 20.

Figure 4A:
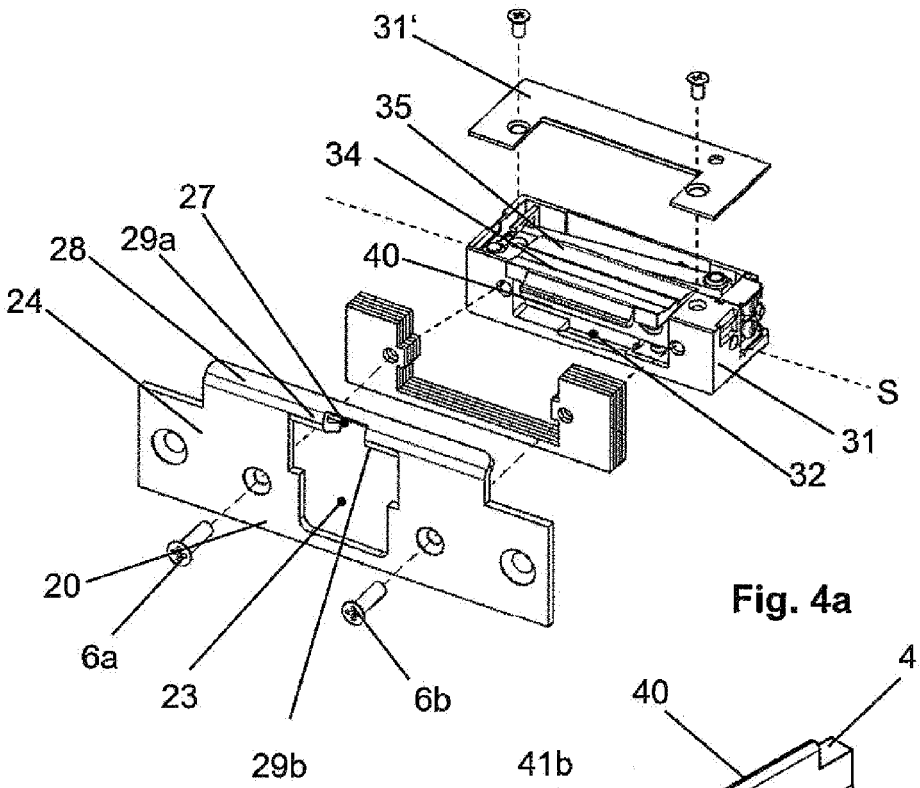
FIG. 4*a*: shows the striker plate according to the invention in the first embodiment having a second door opener unit in an exploded view.
Figure 4C:
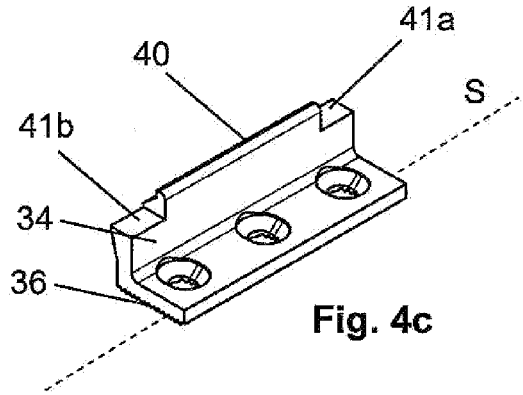
FIG. 4*c*: shows a screw-on part of the door opener from FIGS. 4*a* and 4*b* in a perspective view.
Figure 4B:
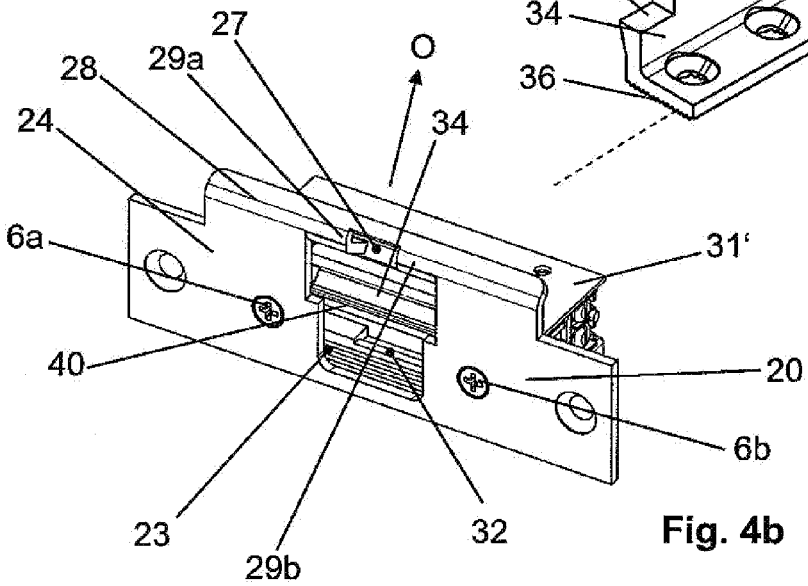
FIG. 4*b*: shows the embodiment from FIG. 4*a* having the door opener unit in a perspective view.
Figure 5A:
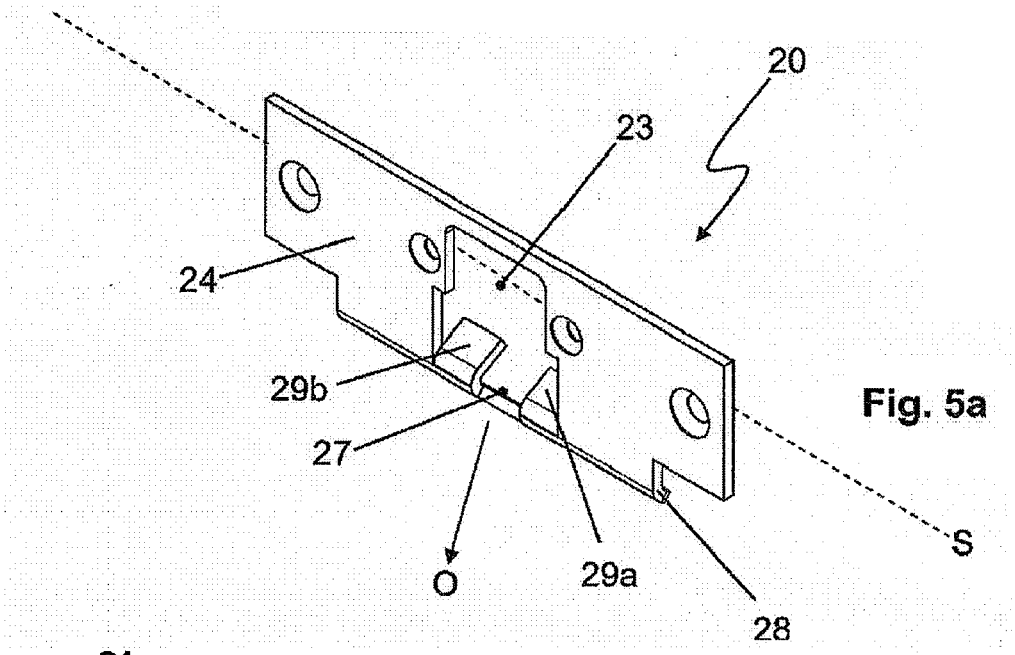
FIG. 5*a*: shows a perspective lateral top view of a striker plate according to the invention.
Figure 5B:
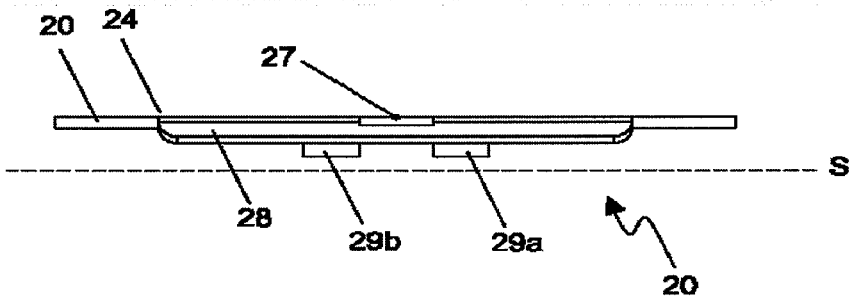
FIG. 5*b*: shows a front view of the striker plate from FIG. 5*a* in the closing direction.
Figure 5C:
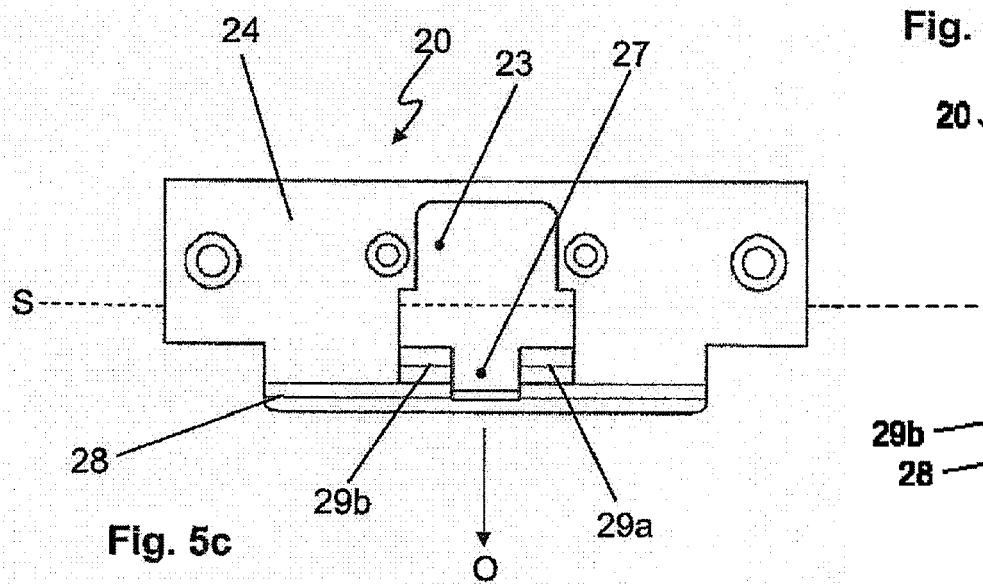
FIG. 5*c*: shows a top view of the striker plate from FIGS. 5*a* and 5*b;*
Figure 5D:
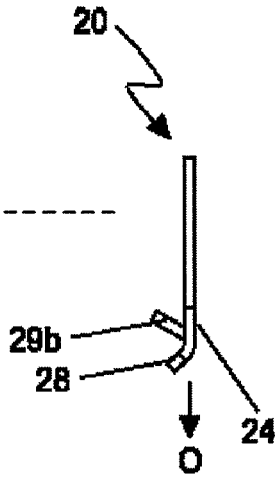
FIG. 5*d*: shows a side view of the striker plate from FIGS. 5*a*, 5*b*, and 5*c;*

The unblocking recess 27 ensures that the lock latch sliding over the sliding bevels 29*a* and 29*b* in the door opening direction O may carry along the tracer pin via the driver mechanism present in the door lock far enough in the direction of the door lock and/or out of the lock latch receptacle space 22 that the tracer pin is lifted over the striker plate outside surface 24 and does not strike against an inner edge of the lock latch recess 23 on the striker plate side in the door opening direction and/or overcomes the striker plate 20 in the door opening direction O without stopping. It is thus only possible to push open the door without jamming and/or unobstructed with the aid of the unblocking recess 27. In contrast to FIGS. 3*a* and 3*b*, the door opener 31 (having cover 31') in FIGS. 4*a*, 4*b*, and 4*c* has a recess 32 and a stop 34, adjustable in relation to the pivot latch 35 and L-shaped in cross-section, which may be screwed onto the pivot latch 35. To stabilize the positioning of the adjustable stop 34 on the pivot latch 35, a catch serration 36 is provided on the adjustable stop 34 and on the pivot latch 35 in the form of clamping ribs. In addition, the recesses 41*a* and 41*b* are provided in the area of the front edge 40 of the adjustable stop 34 in relation to the pivot axis S of the adjustable stop 34 in the boundary area of the front edge 40, the pivot latch 35 projecting into the lock latch recess 23 of the striker plate 20 with the area of the front edge 40 in the "lock latch blocking position" in the two recesses 41*a* and 41*b* lying in front of and behind the front edge or in front of and behind the lock latch recess 23 in the direction of the pivot axis S. The pivot latch 35 is thus implemented as significantly longer along its pivot axis S than the longitudinal extension of the lock latch recess 23 on the striker plate side running parallel to the pivot axis S, by which an especially resistant embodiment of a door locking system according to the present invention is obtained.

Further details of the striker plate 20 are disclosed in FIGS. 5*a*, 5*b*, 5*c*, and 5*d*. According to FIG. 5*a*, the two structurally identical sliding bevels 29*a* and 29*b* are situated on the striker plate 20 in such a way that they run from the striker plate outside surface 24 opposite to the door opening direction O toward the lock latch recess 23. The sliding bevels 29*a* and 29*b* delimit the dimensions of the unblocking recess 27 on both sides in relation to the pivot axis S of the blocking piece (not shown) of a door opener (not shown) screwed onto the striker plate. In relation to the sliding bevels 29*a* and 29*b*, the entry bevel 28 does not run toward the lock latch recess 23, but rather in the door opening direction O. The striker plate 20 is also beveled in the area of the entry bevel 28 in such a way that the striker plate 20 runs in this area in the direction of the surface of the striker plate 20 opposite to the striker plate outside surface 24. In the side view shown in FIG. 5*d*, the sliding bevels 29*a* and 29*b* and the entry bevel 28 thus form a V-shaped profile 21 with one another. Furthermore, the unblocking recess 27 runs into the area of the entry bevel 28, so that the striker plate outside surface 24 is slightly depressed in the door opening direction O in the end area of the unblocking recess 27. In this way, in the front view in the door opening direction O shown in FIG. 5*b*, a depression results in the striker plate 20 in relation to the essentially planar striker plate outside surface 24 in the area of the unblocking recess 27, through which a lock latch blocking device, such as the tracer pin 4 from FIG. 1, may more easily overcome the striker plate outside surface. This is easier because the stroke distance of the tracer pin 4 in the direction of the door lock necessary to overcome the striker plate outside surface is shortened, because now the actual striker plate outside surface 24 does not have to be overcome by the tracer pin, but rather the outside surface in the area of the depression.

Figure 6:
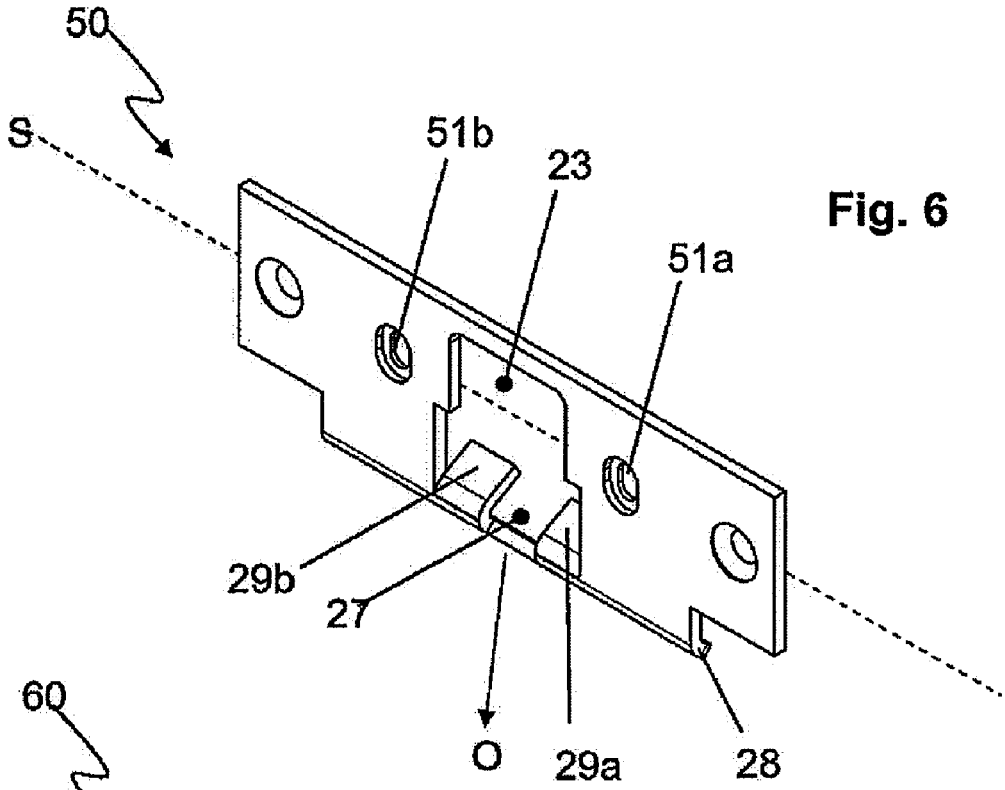
FIG. 6: shows a second embodiment of a striker plate according to the invention in a perspective view.

In the alternative embodiment of the striker plate 50 shown in FIG. 6, the oblong holes 51*a* and 51*b* are also provided, via which an adjustment of the striker plate 50 in relation to the door opener (not shown) screwed onto the striker plate 50 in the door opening direction O is made possible. For this purpose, a door opener (such as the door opener 31 from FIG. 4*a*) is screwed on via the fastening screws 6*a* and 6*b* (from FIG. 4*a*) guided through the oblong holes. The door opener may now be shifted along the oblong holes in relation to the striker plate.

Figure 7:
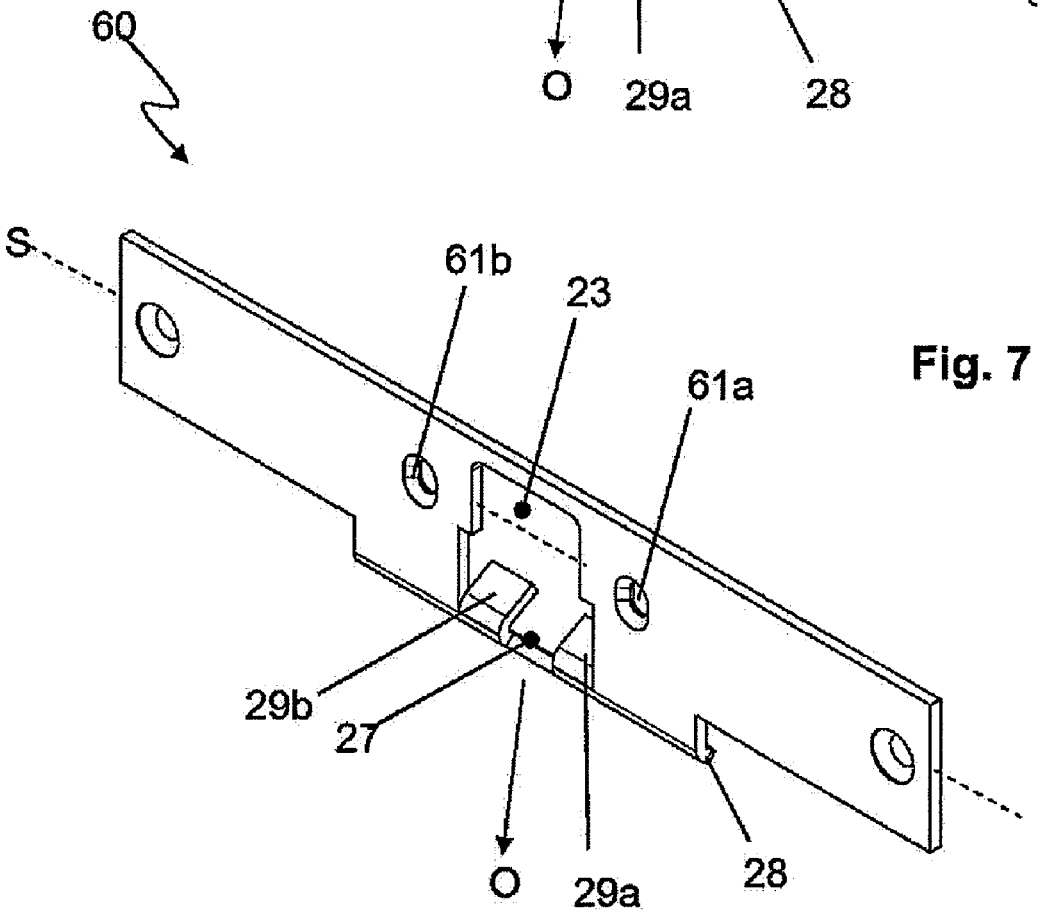
FIG. 7: shows a third embodiment of a striker plate according to the invention in a perspective view.

The striker plate 60 lengthened in the axial direction of the pivot axis S shown in FIG. 7 also has oblong holes of this type for adjusting the position of the door opener (not shown) in relation to the striker plate 60 (oblong holes 61*a* and 61*b*).

Figure 8A:
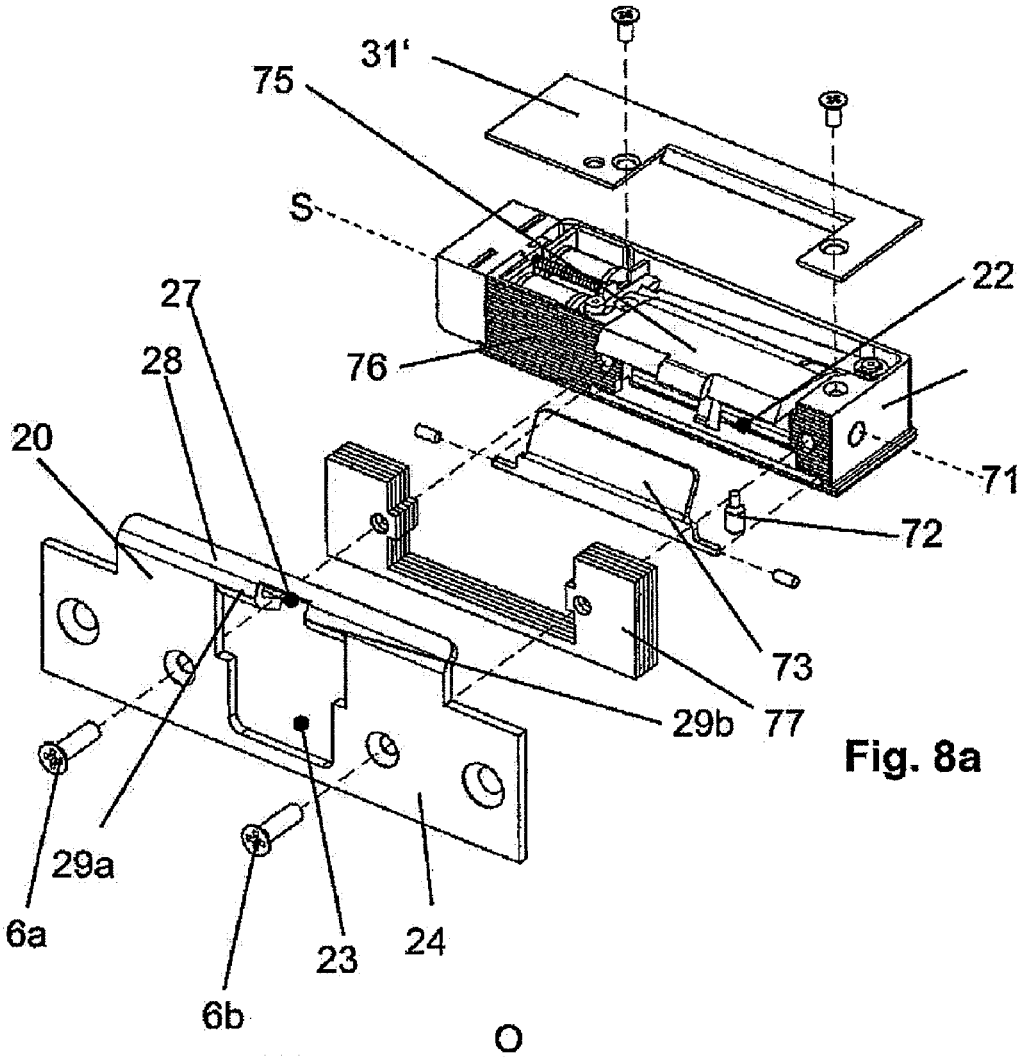
FIG. 8*a*: shows the striker plate according to the invention in the first embodiment having a further embodiment of a door opener in an exploded view.
Figure 8B:
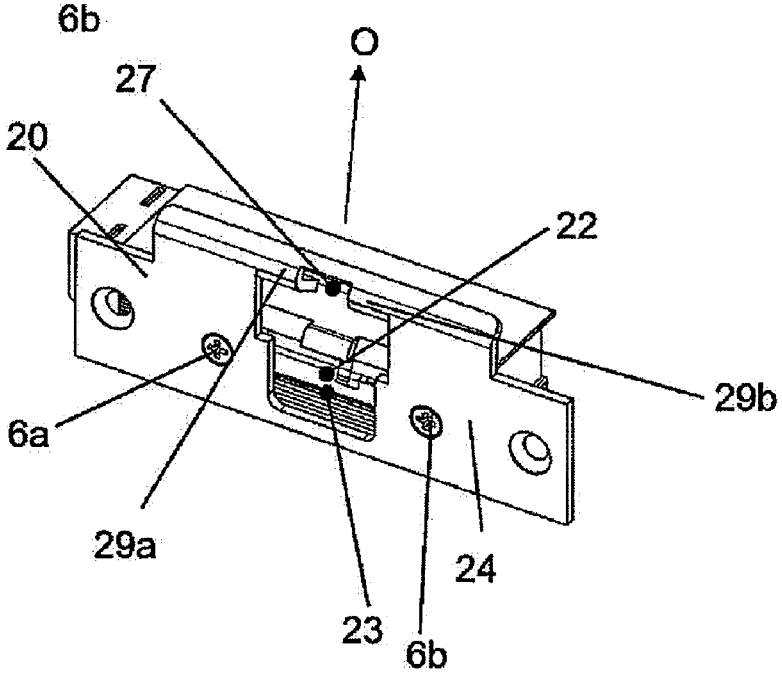
FIG. 8*b*: shows a perspective view of the striker plate from FIG. 8*a* having door opener.

According to FIGS. 8*a* and 8*b*, the door opener 71 is also especially well suitable for use in a door locking system having a striker plate 20 according to the invention. In contrast to the door openers from the preceding figures, the door opener 71 has an adjustment device having a set screw 72 for adjusting the rotational angle stop of the pivot latch 75. This adjustment device thus allows, by rotating the set screw 72 acting directly on the pivot latch 75 in and out, which pivots into the lock latch blocking position opposite to the pivot direction, the dimension to be adjusted of how far the pivot latch 75 is to pivot from the "lock latch release position" pivoted into the door opener 71 into the pivoted-out "lock latch blocking position". Furthermore, a closing contact for sensing the lock latch of a door lock (as in FIG. 1, for example) projecting into the lock latch receptacle space 22 is provided in the door opener 71. For this purpose, the lock latch actuates the contact plate 73 mounted so it is pivotable in the lock latch receptacle space, which in turn activates a switch (not shown). Finally, clamping ribs 76 are provided on the housing of the door opener 71, via which a catch serration with the spacer 77, constructed from multiple spacer plates, which also has corresponding clamping ribs on the side (not visible) facing toward the door opener, may be achieved. Using the catch serration obtained via the interlocking clamping ribs 76 of the spacer 77 and the door opener housing, especially secure positioning of the spacer 77 in relation to the door opener 71 is possible.

Figure 9A:
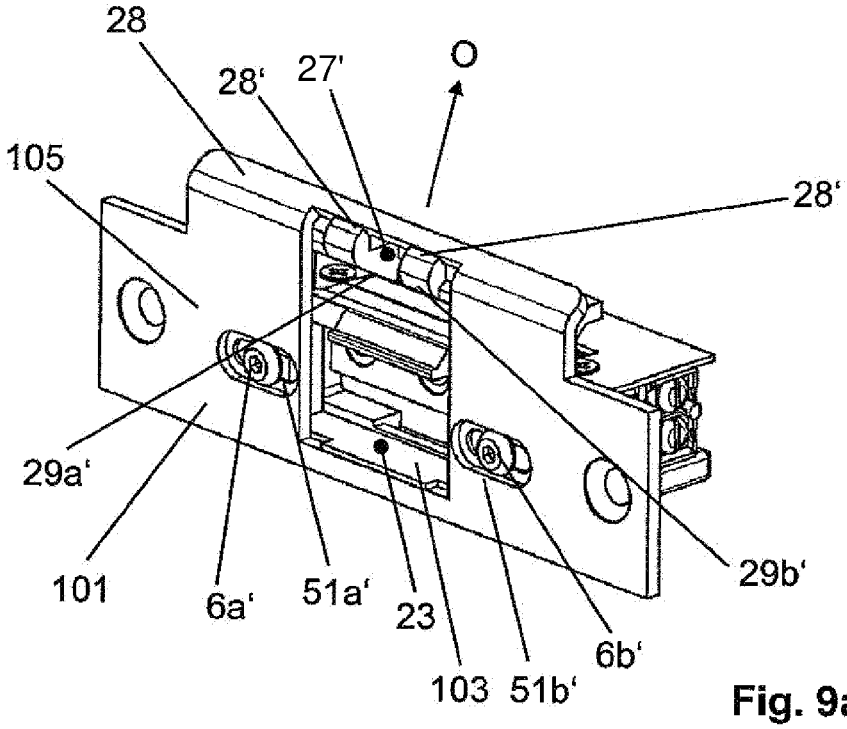
FIG. 9*a*: shows a fourth embodiment of a striker plate according to the invention having a door opener unit.
Figure 9B:
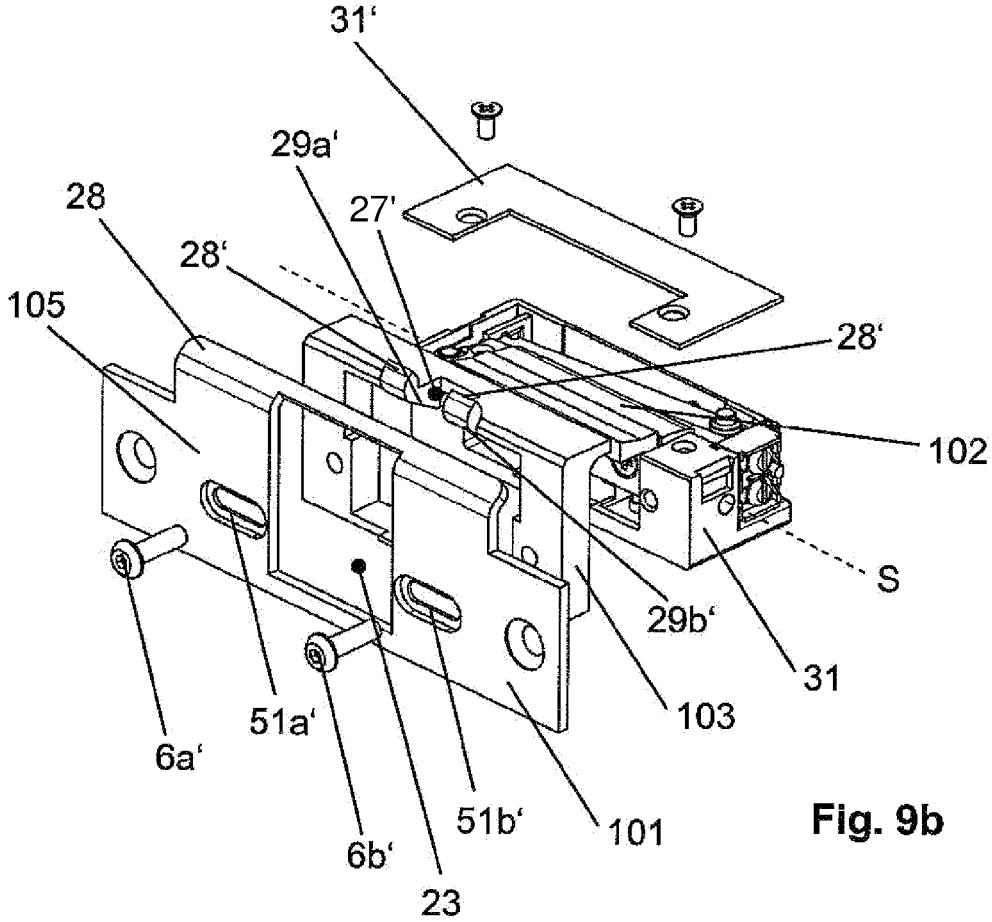
FIG. 9*b*: shows the fourth embodiment of a striker plate according to the invention having a door opener unit from FIG. 9*a* in an exploded view.

Finally, the exemplary embodiment from FIGS. 9*a* and 9*b* is distinguished in particular, in contrast to the preceding exemplary embodiments, by the spacer 103, which is implemented in one piece. The spacer 103 simultaneously fulfills, in addition to the spacing function between the door opener 31 and the striker plate 101, a sliding function for the lock latch (not shown) sliding into and out of the door opener 31. For this purpose, the spacer comprises the sliding bevels 29*a*' and 29*b*', for example, which run from the surface 105 of the striker plate 101 into the lock latch receptacle space 23 of the door opener 31 and allow the lock latch (not shown) to slide over the striker plate 101 and/or the spacer 103, after the blocking piece 102 has released the lock latch. In this embodiment, in contrast to the preceding exemplary embodiments, no sliding bevels on the striker plate side into the lock latch receptacle space 23 are necessary. Furthermore, an unblocking recess 27' is situated on the spacer 103 between the two sliding bevels 29*a*' and 29*b*'. The unblocking recess 27' is thus not formed by the striker plate in this exemplary embodiment, but rather is integrated in the spacer 103. In addition, the striker plate 101 comprises two entry bevels 28' situated opposite to one another, which run corresponding to the entry bevel 28 of the striker plate 101 coming from the striker plate surface 105. These entry bevels 28' are implemented in such a way that the lock latch (not shown) sliding over the striker plate 101 opposite to the door opening direction O first slides over a web-like area of the striker plate 101 mounted in front of the sliding bevels 28' and subsequently slides nearly without a transition over the sliding bevels 28' on the spacer 103. A further special feature of the spacer 101 is that it, like the lock latch recess in the striker plate 103, also completely encloses the lock latch receptacle space 23 in the plane of the striker plate surface 105.

Finally, the exemplary embodiment 100 from FIGS. 9*a* and 9*b* is implemented in such a way that it allows adjustability of the spacer 103 and/or the door opener 31 parallel to the pivot axis S of the blocking piece, which typically corresponds to adjustability in the vertical direction of the striker plate 101 installed in a door frame (not shown). For this purpose, the longitudinal axis of the oblong holes 51*a*' and 51*b*' does not run orthogonally to the pivot axis S as in the preceding exemplary embodiment, but rather parallel to the pivot axis S. To allow adjustability of the spacer 103, which in the exemplary embodiment 100 particularly projects in the area of the entry bevels 28' and the sliding bevels 29*a*' and 29*b*' into the striker plate 101, along the pivot axis S, the sliding bevels 29*a*' and 29*b*' and/or the entry bevels 28' do not terminate flush with the striker plate 101 in the direction of the pivot axis S. Rather, an opening 106 or 106' is provided between the sides of the sliding bevels 29*a*' and 29*b*' and/or of the entry bevels 28' facing toward one another in the striker plate 101, within which the spacer 103 may be shifted in relation to the striker plate 101 in the direction of the pivot axis S. The subsequent position fixing is performed by tightening the fastening screws 6*a*' and 6*b*' (whose thread is not shown in FIGS. 9*a* and 9*b*).

The invention claimed is:

1. A door locking system, comprising:

a door lock situated in a door, including:

a lock latch, having a curved front surface and a planar rear surface, movable between a locked position, in which the lock latch is extended from the door, and an unlocked position in which the lock latch is retracted into the door, a lock latch blocking device movable between a release position, in which the lock latch blocking device is extended from the door and allows the lock latch to move from the locked position to the unlocked position, and a blocking position in which the lock latch blocking device is retracted into the door and prevents the lock latch from moving from the locked position to the unlocked position, and an actuating mechanism, coupled to the lock latch and the lock latch blocking device, to move the lock latch between the locked and unlocked positions and to move the lock latch blocking device between the release and blocking positions;

a door opener, including:

a lock latch receptacle space to receive the lock latch in the locked position, and an electromagnetically-actuated pivot latch, having a front edge, movable between a lock latch blocking position and a lock latch release position;

an essentially planar striker plate, including:

a lock latch recess, and an entry bevel extending in a door opening direction; and a spacer, located between the striker plate and the door opener, including:

two sliding bevels, extending into the lock latch receptacle space and defining an unblocking recess therebetween;

wherein, when the lock latch moves from the locked position to the unlocked position, the lock latch blocking device moves from the release position to the blocking position, wherein, when the door is pushed closed:

the lock latch front surface slides along the entry bevel, which moves the lock latch to the unlocked position and the lock latch blocking device to the blocking position, the lock latch front surface slides over the pivot latch front edge, enters the lock latch receptacle area and moves to the locked position, and the lock latch blocking device remains outside of the lock latch receptacle area in the blocking position, supported by the pivot latch front edge, and wherein, when the pivot latch is electromagnetically released and the door is pushed open:

the pivot latch moves from the lock latch blocking position to the lock latch release position, which allows the lock latch blocking device to move from the blocking position to the release position, the lock latch blocking device enters the unblocking recess, the lock latch slides over the sliding bevels, which moves the lock latch to the unlocked position and the lock latch blocking device to the blocking position, the lock latch slides over the entry bevel, clears the striker plate and moves to the locked position, and the lock latch blocking device moves to the release position.

2. The door locking system according to claim 1, wherein the outside edge of the pivot latch has a receptacle recess, which is implemented in such a way that the lock latch blocking device, which is seated on the outside edge and thus held in the blocking position, projects into the receptacle recess.

3. The door locking system according to claim 1, wherein the unblocking recess has a reduced dimension in the striker plate plane and orthogonally to the door opening direction in relation to the lock latch recess.

4. The door locking system according to claim 1, wherein the lock latch recess and the unblocking recess have a shared axis of symmetry in the door opening direction.

5. The door locking system according to claim 1, wherein, upon closing of the door, the lock latch slides over the entry bevel, which controls a displacement of the lock latch in the direction of the unlocked position.

6. The door locking system according to claim 5, wherein the entry bevel is implemented as convex in the door opening direction.

7. The door locking system according to claim 5, wherein the unblocking recess extends up into the entry bevel.

8. The door locking system according to claim 1, wherein the striker plate is connected to the door opener via a screw connection, the striker plate having a first oblong hole, which is situated above the lock latch recess in the door opening direction, and a second oblong hole, which is situated below the lock latch recess in the door opening direction, for this purpose, the first and second oblong holes being situated on the striker plate in such a way that the relative position of the door opener in relation to the striker plate is variable in the door opening direction or vertically to the door opening direction.

9. The door locking system according to claim 1, wherein the lock latch recess is completely enclosed by the striker plate.

10. The door locking system according to claim 1, wherein the lock latch blocking device is a tracer pin.

* * * * *